US005407697A

United States Patent [19]

Buecher et al.

[11] Patent Number: 5,407,697

[45] Date of Patent: Apr. 18, 1995

[54] CONTINUOUS MELT COATING METHOD AND APPARATUS

[75] Inventors: Udo W. Buecher; Trevor J. Horton, both of New South Wales, Australia

[73] Assignees: John Lysaght Limited; Taubmans Proprietary Limited, both of Australia

[21] Appl. No.: 89,826

[22] Filed: Jul. 7, 1993

[30] Foreign Application Priority Data

Jul. 7, 1992 [AU] Australia ..... PL3388

[51] Int. Cl.[6] ..... B05D 1/00

[52] U.S. Cl. ..... 427/11; 427/277; 427/278; 427/365; 427/369; 427/388.3; 427/287; 118/76; 118/77; 156/231; 156/238

[58] Field of Search ..... 427/277, 278, 11, 365, 427/369, 388.1, 388.2, 388.3, 286, 287, 318; 118/77, 119, 122, 126, 76; 156/230, 231, 238

[56] References Cited

U.S. PATENT DOCUMENTS

| | | | |
|---|---|---|---|
| 257,761 | 5/1882 | Ridgway | 118/77 |
| 2,327,739 | 8/1943 | Peters | 175/366 |
| 3,305,392 | 2/1967 | Britt | 117/154 |
| 3,551,184 | 12/1970 | Dremann et al. | 117/50 |
| 3,630,802 | 12/1971 | Dettling | 156/231 |
| 3,791,856 | 2/1974 | Duling et al. | 117/155 UA |
| 5,059,446 | 10/1991 | Winkle, Sr. et al. | 427/386 |
| 5,077,080 | 12/1991 | Zeiss et al. | 427/11 |
| 5,281,435 | 1/1994 | Buecher | 427/11 |

FOREIGN PATENT DOCUMENTS

0424551A1 5/1991 European Pat. Off. .

*Primary Examiner*—Shrive Beck
*Assistant Examiner*—Brian K. Talbot
*Attorney, Agent, or Firm*—Nikaido, Marmelstein, Murray & Oram

[57] ABSTRACT

A method of continuously painting one side of a moving substrate metal strip (1) utilizing a thermosetting polymer based paint composition comprises pre-heating the strip in a pre-heat furnace (2) to a pre-heat temperature above the glass transition temperature of the paint composition, driving a solid block (8) of the paint composition into collision with the strip at a predetermined block speed to cause liquid paint to be melted from the block and applied to the strip at a precisely controlled deposition rate. The deposit, which for thin paint coats is discontinuous, is then spread over the surface of the strip by a pressure roll (14) and emerges therefrom as a smooth coat of wet paint. A bead of liquid paint (17) builds up on the strip on the up stream side of the pressure roll and the block speed may be adjusted in response to the bead size. The emergent strip then travels through a paint curing furnace (5) and a bath (6) to complete the process.

12 Claims, 1 Drawing Sheet

CONTINUOUS MELT COATING METHOD AND APPARATUS

TECHNICAL FIELD

This invention relates to the coating of substrates by methods wherein coating material is applied to the substrate as liquid melted from a solid body of the material. In this context the term "liquid" includes high viscosity liquids, that may approach soft, plastic solids in nature, as well as easily flowing liquids. That mode of applying coating material to a substrate is referred to as "melt coating" hereinafter. More specifically the invention relates to continuous melt coating processes for applying a coat of thermosetting polymeric paint to a metal strip.

BACKGROUND ART

Basically, melt-coating has been effected hitherto by pressing a body of the coating material against the substrate while one is moving relative to the other, and at the same time causing material to melt from the face of the body that rubs against the substrate.

In some instances, the heat for melting the coating material has been generated as a result of frictional heating arising from the pressure and movement between the body and the substrate. In these instances the pressure between the body and substrate is necessarily high. Reference may be made to the following patent specifications, which exemplify this known melt-coating technique: U.S. Pat. No. 4,959,241 (Thomas et al), U.S. Pat. No. 4,930,675 (Bedford et al) and U.S. Pat. No. 3,553,007 (Hennig).

In other instances, the substrate has been preheated so that the surface of the body rubbing against the substrate is heated primarily by conduction from the substrate. In these instances the pressure between the body and the substrate may be lower, but it has always been at least sufficient to ensure the production of a continuous deposit on the substrate. Typical examples of this melt-coating technique are disclosed in patent specifications U.S. Pat. No. 3,630,802 (Dettling), U.S. Pat. No. 3,551,184 (Dremann et al), U.S. Pat. No. 2,327,739 (Peters) and applicants' own AU 10071/92.

The present invention is concerned with the last mentioned technique wherein the heat is supplied by preheating the substrate. In relation to that technique, the rubbing pressure has to be carefully controlled or some additional procedure has to be taken to obtain a finished coating of the required thickness.

Thus, according to U.S. Pat. No. 3,551,184 an adherent, thin film of metallic lithium is first formed by "wetting" the substrate with lithium while the substrate is well above the melting point of lithium, and that adherent film is then made thicker by depositing molten lithium on it; similarly, in U.S. Pat. No. 2,327,739 an initial thin film of selenium, formed by careful control of the substrate temperature to a value just above the melting point of selenium, is itself overlaid with one or more further deposits to reach a desired thickness; in U.S. Pat. No. 3,630,802 a metering gate controls the thickness of an excessively thick deposit of polymeric material on a carrier strip, presumably with undesirable spillage from the strip edges; whereas in AU 10071/92, other relevant variable parameters, such as substrate speed and temperature, are kept constant, and the pressure between a block of polymeric paint composition and a steel strip is adjusted to establish a deposition rate corresponding to the required thickness of the finished coating, and then kept constant so as to maintain that rate.

Thus, in the methods of AU 10071/92, the thickness of the finished coating may be seen as a constant parameter of a steady state condition established by maintaining all the relevant factors, including the load on the body determining the pressure between the body and the substrate, substantially constant. However, in practice it is not feasible to keep such factors as substrate temperature and body consistency perfectly constant, so that some undesirable variation in coating thickness invariably occurs.

DISCLOSURE OF INVENTION

The present invention provides an alternative mode of controlling the deposition of the liquid, and the eventual coating thickness, in melt-coating processes for the continuous application of coatings of polymeric paints to metal strip, that overcomes the undesirable features indicated above in respect of the inventions described in U.S. Pat. No. 3,630,802 and AU 10071/92. The invention is particularly advantageous when thin coats of paint are required.

The invention consists in a method of continuously painting at least a part of at least one side of a moving substrate strip utilising a thermosetting polymer based paint composition having a glass transition temperature, comprising the steps of pre-heating the strip to a preheat temperature above said glass transition temperature, moving the preheated strip at a predetermined strip speed, driving a solid block of the paint composition along an axis of the block into collision with said side of the moving strip at a predetermined block speed to cause a liquid deposit of said paint composition to be melted from said block and to be carried away from the block on said side of the strip, and thereafter further heating said deposit to produce a thermoset coat of paint covering at least said part of said side of the strip.

In some instances the initial deposit substantially uniformly covers the area of the substrate strip that is to be painted, that is to say the width of the solid block of paint substantially corresponds to the width of the finished painted area of the strip, and the strip speed and block speed are chosen to produce a continuous deposit. Thus, the initial deposit becomes the final coat, directly upon the deposit being cured or thermoset as a result of the further heating. If preferred, such continuous deposits may be smoothed before being caused to set.

In other instances, the initial deposit covers a lesser area of the substrate strip than the area to be painted, and the method of the invention then comprises the further step of spreading the deposit into a substantially uniform layer covering the area to be painted, before that layer is further heated as aforesaid, to produce a thermoset coat of paint covering what then becomes the finished painted area.

In these last mentioned instances the initial deposit may be a continuous deposit covering an area of the substrate narrower than the finished painted area, but, where thin paint coats are required it is a discontinuous deposit. Such a discontinuous deposit may occupy an area that is coextensive with the finished painted area; but, where it is inconvenient to provide a block of exactly the same width as the strip, the discontinuous deposit may occupy an area that is narrower than the finished painted area, without detriment.

In accordance with the invention, the deposition rate per unit area of the substrate strip, and thus the thickness of the finished coat of paint, is determined absolutely by the strip speed and the paint block speed, so that minor variations in strip temperature or paint block consistency cease to have a deleterious effect on the finished product.

In simple embodiments, the strip speed and the block speed are both set to suit the required deposition rate. Either or both could be adjusted as needed to vary the deposition rate. However, in preferred embodiments the strip speed is kept constant and the block speed is adjusted as needed from a nominal set speed to compensate for adventitious variations in the block itself, such as voids, which may influence the deposition rate.

The invention further consists of an apparatus for effecting the above described method comprising means to cause said strip to travel at a predetermined strip speed along a predetermined pass line, and further apparatus for treating the strip sequentially as it travels along the pass line, said further apparatus comprising, preheating means to heat the strip to said pre-heat temperature, a melt-off depositor adapted to hold said block and drive the block along an axis of the block at said predetermined block speed into collision with said side of the pre-heated strip, whereby said deposit is applied to the side of the strip, and curing means whereby the deposit is further heated to a curing temperature to produce an adherent, thermoset coat of paint on the strip.

The term "block", as used herein, indicates a body that has a longitudinal axis and a constant cross-sectional shape in planes perpendicular to that axis. A rectangular prism is a preferred block of that kind. It will be apparent that when such a block is driven axially, that is to say in the direction of its longitudinal axis, against a flat strip, the area of impingement on the strip remains constant.

In some embodiments of apparatus according to the invention, the said further apparatus may further comprise spreading means for spreading the initial deposit over a predetermined area of the substrate greater than that covered or occupied by the initial deposit. Such spreading means may comprise a simple doctor blade. Moreover, for preference, smoothing means are provided to smooth the exposed surface of the initial deposit or that deposit after it has been spread, as the case may be. In some instances the spreading and smoothing means may be present as separate items, whereas, in others, the spreading means may also serve to smooth the spread deposit.

Indeed, in preferred embodiments of the invention novel spreading means able not only to spread the deposit but also to produce a smooth emergent coat of wet paint are provided. Those means may comprise a single, smooth surfaced, power driven pressure roll bearing on the initial deposit and pressing it against the substrate strip. The roll is preferably driven so that its surface speed is not identical to the strip speed. Such a roll acts as doctor means to spread the initial deposit, and, as a result of its rotation, "irons" the deposit to produce a smooth surface thereon.

Alternatively dual function spreading and smoothing means may comprise a gas curtain impinging on the initial deposit. Such a curtain may be defined and directed by a nozzle or aperture extending transversely of the strip. A gas stream constituting the curtain issues from that nozzle and is controlled so that the curtain obstructs but does not prevent the flow of liquid deposit through it.

In either instance, the initial deposit, on reaching the spreading and smoothing means builds up to some extent before escaping under them as a smooth coat on the strip. Thus, in operation the aforesaid combined spreading and smoothing means create what may be termed a "plenum" bead of liquid paint extending across the strip immediately adjacent the upstream side of those means. The rough and/or discontinuous initial deposit feeds into the said plenum bead and the escaping smooth coat draws paint from it.

Where the quantity of liquid in the deposited material is correctly set, the spreading means may spread it to the edges of the strip but not beyond. That is to say the spread deposit may coat the full width of the strip, without there being any significant spillage.

Feed rate monitoring and control means are provided in preferred embodiments. Those means are responsive to the size of the said plenum bead, and adjust the strip speed or the block speed, preferably the latter, to compensate for adventitious voids or the like in the block that would otherwise affect the deposition rate.

Thus the invention is founded in the appreciation that the rate of deposition in a melt-coating process of the kind utilising a paint block and a pre-heated substrate may be controlled by controlling the strip speed and the block speed, provided the speeds are such that all of the paint melted-off from the block is carried away on the strip. If that proviso is not met, the pressure between the block and strip in systems according to the invention will rise to the point where the system fails, by shattering or adverse deformation of the block, or otherwise. That proviso is unfailingly met if the initial liquid deposit is discontinuous, In that further paint could always be carried away by a more nearly continuous deposit, hence the stated preference for discontinuous deposition, a preference which, hitherto has been regarded as completely unacceptable and which has previously been avoided at all costs.

According to the invention an initially discontinuous deposit, for example a patchy or streaky deposit, is acceptable, at least when the aforesaid dual function spreading and smoothing means are used for its subsequent rectification, because of the easy and precise control made available by the invention over the deposit rate, that is the amount of liquid deposited per unit area of substrate.

Furthermore, in the continuous painting of metal strip by melt-coating, it is sometimes desirable to use paint bodies of large cross-section, so that bodies that are not inconveniently long may nevertheless supply melt-off material for a considerable time. This permits desirably long intervals between replacements of spent bodies with fresh ones.

Obviously the width of the strip being painted puts a limit on the dimension of the block cross-section that extends transversely of the strip, and hitherto the dimension of the block cross-section that extends longitudinally of the strip (in its direction of travel), for given strip temperatures, paint compositions and strip speed, has imposed a limit on the minimum thickness of a continuous deposit that may be obtained by reducing the wiping pressure. The invention overcomes that restriction and permits longer paint block dimensions in the direction of strip travel than has been possible hitherto for a required coating thickness.

The invention also enables a relatively small number of stock block sizes to be used to paint substrate strips having a wide variety of widths.

BRIEF DESCRIPTION OF DRAWINGS

By way of example, an embodiment of the above described invention is described in more detail hereinafter with reference to the accompanying drawings.

BEST MODE OF CARRYING OUT THE INVENTION

Figure 2:
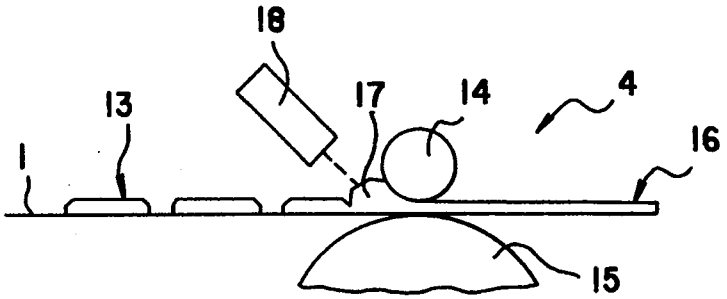
FIG. 2 is a detail view similar to FIG. 1 of the spreading and smoothing means of FIG. 1, drawn to a larger scale.
Figure 1:
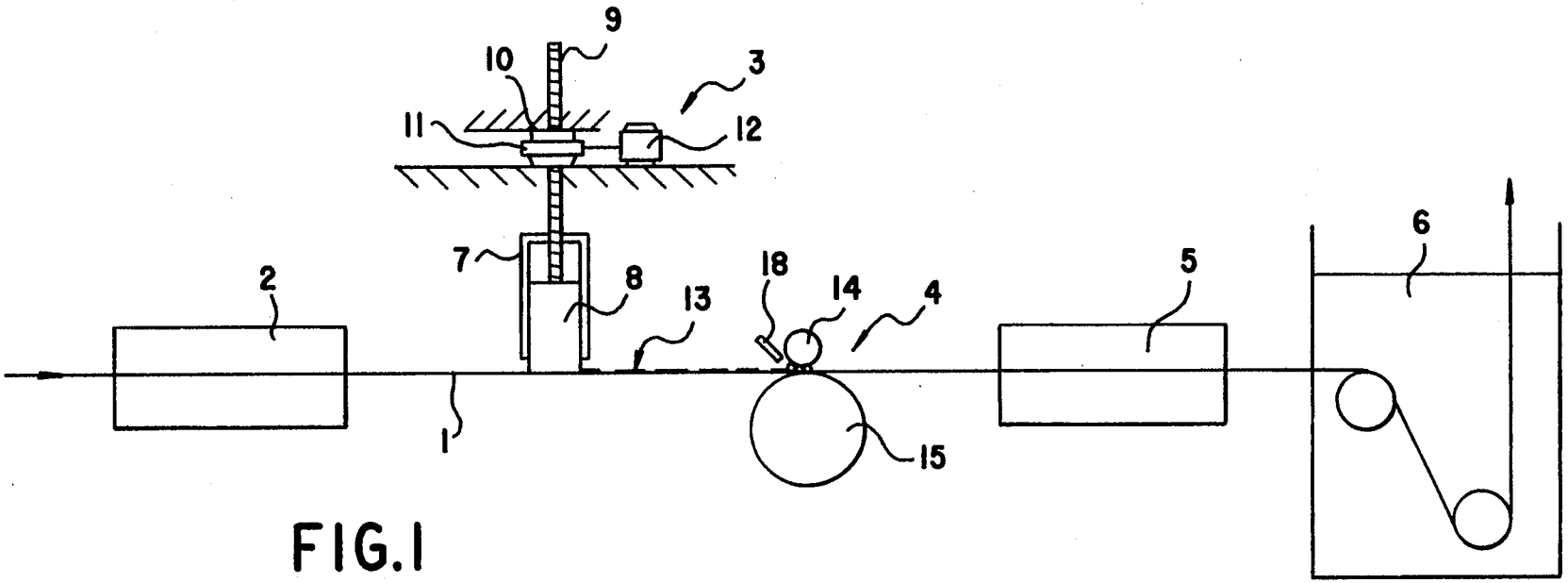
FIG. 1 is a diagrammatic side elevation of a continuous, strip coating production line according to the invention.

In accordance with the illustrated embodiment of the invention, a steel strip 1, which is to be continuously painted on one side, is caused to travel sequentially through a pre-heating furnace 2, a melt-off depositor 3, a spreading and .smoothing means 4, a curing furnace 5, and a quenching bath 6.

The illustrated apparatus may be an integral, final part of a continuous galvanising line, but more usually it is fed from a conventional uncoiler (not shown) loaded with coiled strip from stock. The coated strip emerging from the bath 6 is taken up by a conventional re-coiler (not shown) and the line would be fitted with other conventional adjuncts, such as accumulators and means to maintain tension in the strip.

The incoming strip 1 is pre-treated to render it suitable for receiving a finishing coat of paint, that is to say it would be levelled, cleaned and probably primed. All of these operations may be effected by conventional means. In particular, the strip may be primed with a solvent based primer paint in the usual manner, wherein the strip with a liquid coat of primer paint on it is passed through a conventional curing furnace to drive off the solvent and cure the primer. The primer coat is preferably very thin, preferably about 5 microns, and so requires relatively little solvent to be used in its formation. Alternatively, the primer coat may itself be applied by a melt-coating method or apparatus according to the present invention.

The primed strip emerges from the primer curing furnace at a temperature at least approaching that required for the melt-off of the solid, un-set paint composition. Indeed, in installations where the strip proceeds directly from the priming station to the finish coating station, the priming furnace may be controlled to ensure that the strip leaves it at an appropriate temperature. More usually, however, the primed strip is passed through a dedicated pre-heat furnace 2 to attain that temperature, which is preferably within the range of from 160° C. to 240° C., and then passes to the melt-off depositor 3.

The depositor 3 comprises a chute or guide 7 locating a block 8 of a polymeric, thermosetting, paint composition. The block 8 may be secured to a threaded shaft or feed screw 9, for example by a fitting (not shown) embedded in the block 8 and fixed to the lower end of the feed screw 9, extending through a ring nut 10. The ring nut 10 may be rotated by a worm 11 driven by a variable speed motor 12. Thus the block 8 is driven into collision with the strip 1 along its longitudinal axis at a predetermined speed that depends on the speed of the motor 12.

Alternatively, the chute or guide may frictionally retain the block, and the end of the feed screw, or, for preference, a load distributing plate thereon, may simply bear upon the block and push it forward by overcoming the frictional restraint.

In use the motor 12 may be furnished with a tachometer providing an output voltage signal which may be compared with a fixed reference voltage, and a damped controller responsive to the difference between the tachometer signal and the reference voltage may adjust the motor speed to bring the difference to zero. That is to say, the motor may be part of a conventional servomechanism with feed back control, and the reference voltage may be set at any desired value to produce a corresponding fixed speed at which the block 8 is driven against the strip 1. That predetermined block speed is set to suit the desired coating thickness, as described more fully below.

The strip 1, in contact with the block 8, is hotter than the glass transition temperature of the polymeric material in the block, and thus uncured paint composition is melted from the bottom of the block and carried away by the strip as a deposit 13 thereon. The rate of melt-off is affected by several parameters, including the cross-sectional area of the block, the paint's composition and the strip speed and temperature, but where all of the foregoing are fixed, as is preferred in the present instance, and would be so in a normal production plant, it is then determined absolutely by the block speed. Likewise the quantity of liquid paint deposited per unit area of the strip is then determined by the block speed.

In experiments leading to the present invention it was found that if all the mentioned parameters, including strip speed, are constant, then the block speed may be set to produce a discontinuous, patchy, streaked or flecked deposit wherein the individual patches or streaks form a seemingly random pattern but wherein the pattern density, measured over an area that is large by comparison with each patch or streak, is uniform. It seems, from observation, that paint in small areas of the contact face of the block protruding therefrom is pressed against the strip, and is thereby melted and carried away. Those areas then appear to become recessed and contact is transferred to other small areas, and so the process continues, with contact points shifting randomly but evenly over the whole block/strip interface.

In a given situation an appropriate block speed may be determined by calculation. Indeed computerised control means may be used, wherein a signal proportional to strip speed is applied to a computer as input data enabling the computer to calculate the instantaneous block speed required for a given coating thickness and to set the servo reference voltage, and thus the predetermined block speed, accordingly. For preference the finished coat thickness is within the range of from 3 to 25 microns, preferably about 15 microns, and coats of this thickness cannot be applied reliably as initially continuous deposits by methods and apparatus according to the prior art.

The block 8 may be of any high solids, thermosetting polymer based paint composition wherein the polymer has a glass transition temperature appreciably below convenient operating temperatures for the pre-heated strip. Appropriate polymers include polyester, silicone modified polyester, epoxy, acrylic, melamine-formaldehyde, and urethane resins and mixtures thereof.

The discontinuous liquid deposit of paint composition 13 thus formed on the strip 1 is then spread over the entire strip surface, and simultaneously smoothed, by the spreading and smoothing means 4.

The spreading and smoothing means 4 comprise a pressure roll 14, with a tough, firmly resilient, smooth, elastomeric surface layer, working in conjunction with a back up roll 15. The back up roll 15 provides the reaction force enabling the pressure roll 14 to bear against the deposit.

The pressure roll 14 is power driven and may rotate in either direction. For preference, however, it is rotated so that the part of its curved surface contacting the deposit moves in the same direction as the strip 1 at a speed that is about 1–20% that of the strip. This has been found to produce a very smooth surface on the emergent paint coat 16.

As may best be seen in FIG. 2, the discontinuous deposit 13 feeds into a plenum bead 17 of liquid paint that is established by the pressure roll 14 immediately upstream of itself. The plenum bead 17 normally extends just to the edges of the strip 1 but is very small (ideally zero) at the edges. The coat 16, of the required predetermined thickness over the entire surface of the strip 1, is drawn from the bead 17 and emerges from under the pressure roll 14.

A conventional laser or other displacement sensor 18 may be provided to monitor the size of the bead 17. Preferably two such sensors are provided, one disposed at or near each edge of the strip 1, where the bead is ideally barely detectable. Such sensors comprise an emitter and a receiver. The emitter emits a targeted laser beam and the receiver produces an electrical signal derived from the light reflected back from the target. The received light and thus the electrical signal that is produced varies with the distance of the target from the emitter. If those sensors detect an oversized or an undersized plenum bead their signals may be utilised to modify the block speed of the block 8. In the present instance those signals may be used to modify the reference voltage of the servo system including the motor 12, to thereby reset the controlled speed of that motor.

In the event that the signals from the two sensors 18 are not equal, indicating that the bead 17 is not symmetrical across the width of the strip 1, corrective action may be taken. That action may amount to adjusting the loads applied to the ends of the pressure roll 14 to modify the pressure distribution on the deposited paint and/or adjusting the position of the block 8 laterally of the strip 1.

If the spreading and smoothing means comprise a gas curtain their operation depends to some extent on factors such as the fluidity of the coating material at the temperature pertaining and like external parameters specific to a particular operation. It also depends on internal design factors of the spreading and smoothing means, namely the width of the nozzle, the spacing of the nozzle from the strip and the gas pressure. In practice, where the external parameters may change from time to time, it is convenient to adjust the gas pressure and/or the nozzle spacing from the strip to suit, and in preferred embodiments, the gas spreading and smoothing means are adjustable in those respects.

It should be emphasised that the drawings are diagrammatic. In practice the depositor 3 and the spreading and smoothing means are positioned so that there is insufficient time for liquid deposit 13 to increase in viscosity, by cross-linking, to a significant extent before reaching the spreading and smoothing means.

Upon emerging from the spreading and smoothing means 4, the coated strip travels through the curing furnace 5, wherein the coating is heated to a curing temperature of say 220°–270° C., whereby it is cured.

The cured coat of paint and the strip may then be quenched by passage through the bath 6, or otherwise cooled to room temperature for re-coiling and removal as finished product.

It will be appreciated that the illustrated embodiment of the invention described above is but one example, and other embodiments showing considerable variation in detail lie within the scope of the invention.

For example the mechanism for driving the paint block into collision with the strip may take any form consistent with the provision of a predetermined block speed or feed rate as distinct from a predetermined applied pressure.

There may be a plurality of closely adjacent depositors, and means to bring one into operation while the other is being recharged and vice versa.

The mechanism for thrusting the block forward, in a depositor otherwise similar to the illustrated example, may comprise a pneumatic or hydraulic thrustor under the control of a position sensor varying the operating fluid pressure so as to ensure constant speed of block movement.

There may be two devices in series for spreading and smoothing the initial paint deposit, namely an upstream spreader followed by a downstream smoother. In the event that both are gas curtains, they may both emanate from a single supply chamber, although for preference the gas pressure to each would be independently adjustable.

Where both sides of a strip are to be coated the depositor and spreading and smoothing means would be duplicated, with one of each on one side of the strip and the other of each on the other side of the strip. In this event the strip may be arranged to travel vertically between the pair of depositors and between the pair of spreading and smoothing means. For preference the depositor and the spreading and smoothing means on one side of the strip are respectively in register with those on the other, so as to cancel the forces applied to the strip. Also, opposed gas pressure stabilisers, of the kind commonly referred to as floater pads, one on each side of the strip, may be used to stabilise the strip track, and, if gas curtain spreader means are used, each curtain nozzle may conveniently be one of the pressurising nozzles of the floater pad on its side of the strip.

We claim:

1. A method of continuously painting at least a part of at least one side of a moving substrate strip having two longitudinal edges utilizing a paint composition having a glass transition temperature, comprising the steps of:

pre-heating the strip to a pre-heat temperature above said glass transition temperature;

moving the pre-heated strip at a strip speed;

driving a solid block of said paint composition at a block speed in a direction intersecting said side of said moving strip into proximity to said moving strip thereby melting some of said block proximate to said moving strip to form a liquid quantity of said paint composition;

transferring a liquid deposit from said quantity onto said side of said moving strip at a controlled deposition rate which is directly proportional to said block speed;

independently controlling said block speed so as to produce said controlled deposition rate; and thereafter converting said liquid deposit into a coat of paint which covers at least said part of said side of the strip.

2. A method according to claim 1 comprising the further step of smoothing said liquid deposit prior to the convesion thereof.

3. The method as claimed in claim 1 including controlling the movement of said strip at a substantially constant speed.

4. A method as claimed in claim 1 wherein said deposited liquid paint composition substantially covers said side of said moving strip.

5. A method as claimed in claim 2 wherein said liquid deposit does not extend without interruption from edge to edge of said strip.

6. A method as claimed in claim 2 wherein said paint composition comprises a thermosettable resin composition and wherein said converting step includes a step of thermosetting said deposited liquid after it has been smoothed and after it covers substantially all of said surface of said moving strip.

7. A method according to claim 5 wherein said block is narrower than said strip.

8. A method according to claim 5 wherein said block is as wide as said strip but said deposit is discontinuous.

9. The method as claimed in claim 5 including the further step of spreading said liquid deposit to extend without interruption from edge to edge of said strip.

10. A method according to claim 6 wherein said part of said plenum bead comprises two end portions each of which is adjacent the edges respectively of said strip.

11. A method as claimed in claim 6 including heating said resin to a temperature which is sufficient to thermoset it.

12. A method according to claim 9 wherein said spreading is effected by spreading means producing a plenum bead of said liquid deposit of said paint composition extending from edge to edge of said strip, and wherein said block speed is controlled to maintain at least a part of said plenum bead at a substantially constant size.

* * * * *

UNITED STATES PATENT AND TRADEMARK OFFICE

CERTIFICATE OF CORRECTION

PATENT NO. : 5,407,697

DATED : April 18, 1995

INVENTOR(S) : Udo BUECHER et al

It is certified that error appears in the above-identified patent and that said Letters Patent is hereby corrected as shown below:

On the Title Page, Item [73], change " John Lysaght Limited " to -- John Lysaght (Australia) Limited --.

Signed and Sealed this

Twenty-seventh Day of June, 1995

Bruce Lehman

*Attest:*

BRUCE LEHMAN

*Attesting Officer*

*Commissioner of Patents and Trademarks*